United States Patent [19]

Ginsburg

[11] Patent Number: 4,915,375

[45] Date of Patent: Apr. 10, 1990

[54] PEDAL ATTACHMENT FOR AN EXERCISE BIKE

[76] Inventor: Charles R. Ginsburg, 4545 S. Detroit Ave., Toledo, Ohio 43614

[21] Appl. No.: 378,657

[22] Filed: Jul. 12, 1989

[51] Int. Cl.[4] ..... A63B 21/00

[52] U.S. Cl. ..... 272/73; 280/294; 74/594.6

[58] Field of Search ..... 272/93, 73; 74/594.3, 74/594.6, 562, 564; 280/291, 294, 302

[56] References Cited

U.S. PATENT DOCUMENTS 702,862 6/1902 Moss ..... 280/294
2,641,249 6/1953 Brockman ..... 272/73
4,605,242 8/1986 Kimball ..... 280/294

FOREIGN PATENT DOCUMENTS 0284950 2/1928 United Kingdom ..... 280/294

*Primary Examiner*—Stephen R. Crow
*Attorney, Agent, or Firm*—Marshall & Melhorn

[57] ABSTRACT

A pedal attachment for a stationary exercising bike having an extensible support for positively forcing the user's foot to flex relative to the user's calf during the normal cycling movement. The pedal attachment comprises a foot support portion and roller perpendicularly connected to the foot support portion and offset from the pedal axis of rotation thereby flexing a user's foot when the roller engages a support surface.

8 Claims, 2 Drawing Sheets

PEDAL ATTACHMENT FOR AN EXERCISE BIKE

BACKGROUND OF THE INVENTION

The invention relates generally to exercising devices and, more particularly, to a pedal attachment for a stationary exercise bike.

Oftentimes it is necessary for persons suffering chronic circulatory disease to experience rather vigorous exercise of the lower pedal extremities. Certain vigorous walking regimen are indeed found to be satisfactory. However, there are those individuals who may be for other reasons unable to participate in such an exercise regimen for other health or physical reasons or may reside in a region in which the climatic conditions militate against the patient's ability to engage in outdoor exercise. In these instances, the necessary exercise regimen can be effectively achieved by means of indoor stationary exercising equipment such as a stationary exercise bike.

The present invention is adapted for such use and has been found to be extremely effective in maximizing the utilization of indoor exercising cycles to create considerable flexure between the user's feet and calves thereby achieving an increased volume of blood circulation through the pedal extremities.

SUMMARY OF THE INVENTION

The present invention is directed to a simple and relatively inexpensive attachment for the conventional pedal structure of substantially all commercially available stationary exercise bikes.

An object of the invention is to produce an attachment for an exercise bike which will effectively physically force considerably increased flexure between the feet and calves of the user during use of the bike.

Another object of the invention is to produce an attachment for an exercise bike which may be economically manufactured.

Another object of the invention is to produce an attachment for an exercise bike which may be easily attached to the pedal of an exercise bike without requiring special tools or skills.

The above objects as well as other objects of the invention may be effectively achieved by an attachment for the pedal and crank arm linkage of an exercise bike having a frame for supporting the bike on a suitable surface. Comprising: a foot support for accommodating the foot of a user; means secured to the foot support for limiting relative movement between the foot of the user and the support; means for attaching the foot support to the pedal of the exercise bike; and means extending from the foot support to contact the surface during a portion of the rotation of the pedal and the associated crank arm linkage.

BRIEF DESCRIPTION OF THE DRAWINGS

The object and advantages of the invention will become readily apparent from reading the following attached description of the invention when considered in the light of the accompanying drawings, in which.

DETAILED DESCRIPTION OF THE PREFERRED EMBODIMENT

Figure 1:
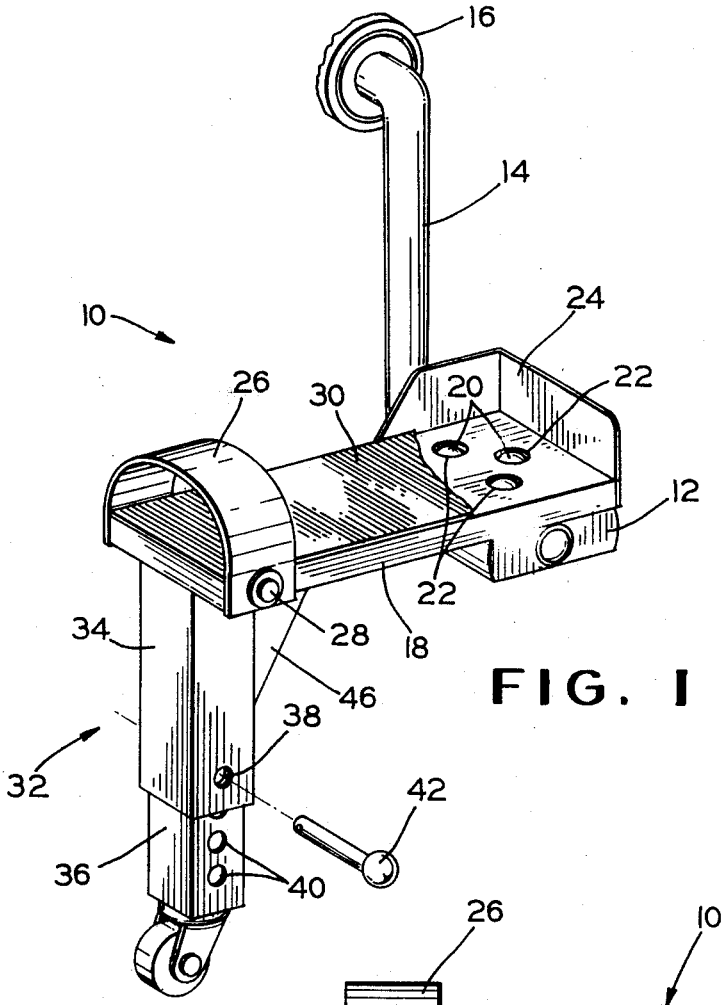
FIG. 1 is perspective view of the invention attached to a pedal of a stationary exercise bike.
Figure 2:
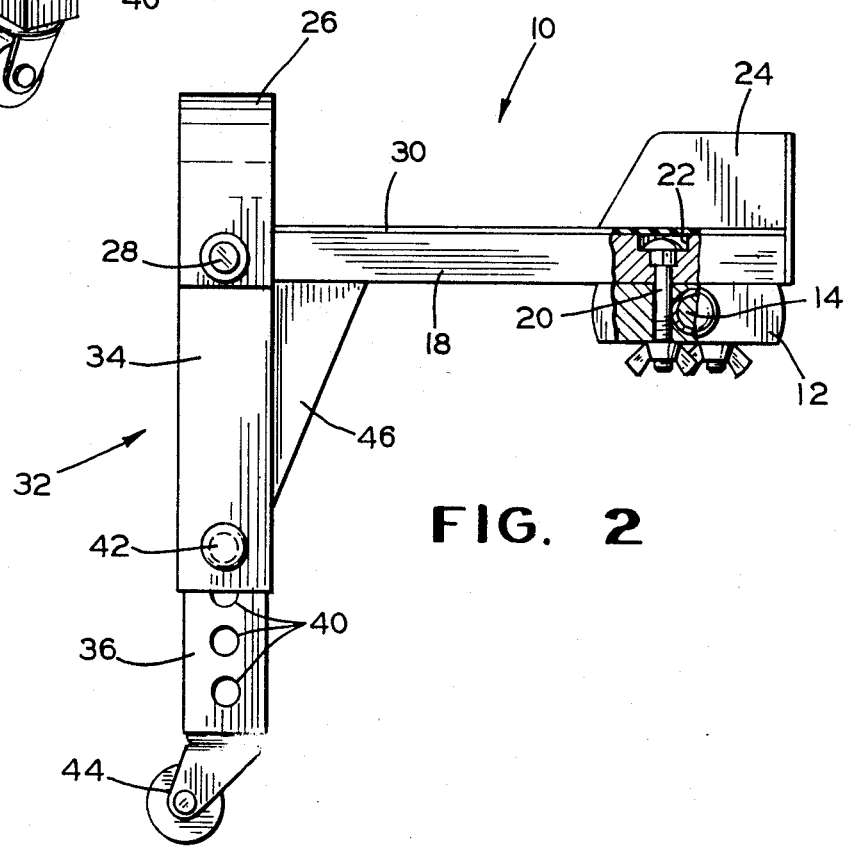
FIG. 2 is an elevational view of the invention illustrated in FIG. 1 with a portion broken-away to more clearly illustrate the means for attaching the invention to the associated pedal.

Referring to FIGS. 1 and 2 of the drawings, the attachment embodying the features of the invention is generally indicated by reference numeral 10. The attachment 10 is connected to a pedal 12 of a typical exercising bike having a crank arm linkage 14 journalled for rotation in a bearing assembly 16 of the exercise bike frame, not shown.

The attachment 10 includes a main body or foot support portion 18 which may be any configuration suitable for supporting the foot of a user. One end of the foot support 18 is connected or affixed to pedal 12 by threaded fasteners 20, for example. The head portions of the fasteners 20 are received in recesses 22 formed to enable the uppermost surfaces of the fasteners 20 to be recessed below the upper surface of the foot support 18. The threaded shank portions of the fasteners 20 extend completely through the main body of the pedal 12 and are secured by suitable bolt means such as wing nuts, for example. The wing nuts are then tightened to securely affix the foot support 18 to the associated pedal 12. An upstanding flange member 24 may be secured in any suitable manner to edge of the foot support 18. While the flange member 24 can be of a number of different configurations, it will be understood that the functional purpose of the flange member 24 is to assist in maintaining the user's heel in operative position on upper surface of the foot support 18. It has been found that satisfactory results can be achieved by utilizing a flange configuration which extends along the rear edge and for a portion of the adjacent innermost side edge as is clearly illustrated in FIG. 1.

A strap 26 is mounted adjacent the opposite end of the foot support 18. Suitable fasteners 28 are utilized to interconnect the strap 26 to the foot support 18. The strap 26 may be adjustable, if desired, to accommodate various sizes and shapes of the user's feet or shoes. It is contemplated that other embodiments of the invention could employ a strap which has one, preferably the inner, end permanently secured to the foot support 18, while the opposite end would be provided with a series of axially aligned and spaced apart apertures which would be selectively attached to an outwardly extending fastening means such as a peg or the like. Such an arrangement could provide the necessary adjustment to accommodate a wide range of sizes and shapes of the user's feet or shoes.

A pad 30 of an elastomeric material such as rubber, for example may be disposed to cover the upper surface of the foot support 18. The pad 30 may have a ribbed or other configuration on the upper surface thereof to aid in pressure relative movement between the user s foot and the foot support 18, and also may provide some cushioning effect to provide increased comfort to the user. The opposite surface of the pad 30 may be adhesively secured to the upper surface of the foot support 18 to prevent relative movement between the pad 30 and the foot support 18.

An extensible leg 32 is attached to the foot support 18 at the end opposite the end secured to the pedal 12, and is caused to depend therefrom. The leg 32 is formed of hollow member 34 and an associated member 36 adapted to be received in telescoping relation within the interior of the member 34. The hollow member 34 is provided with a pair of aligned apertures 38 formed in opposing walls thereof only a single one showing illustrated. The associated member 36 is provided with a series of spaced apart pair of apertures 40, only a single series being illustrated, to provide for adjustability in respect of the length of the leg 32. A removable locking pin 42 is employed to lock the members 34 and 36 once the desired length of the leg 32 is determined and the respective apertures are suitably aligned.

A caster 44 is attached to the distal end of the extensible leg 32.

A strengthening bracket 46 may be utilized to maintain rigidity between the leg 32 and the foot support 18.

Figure 3:
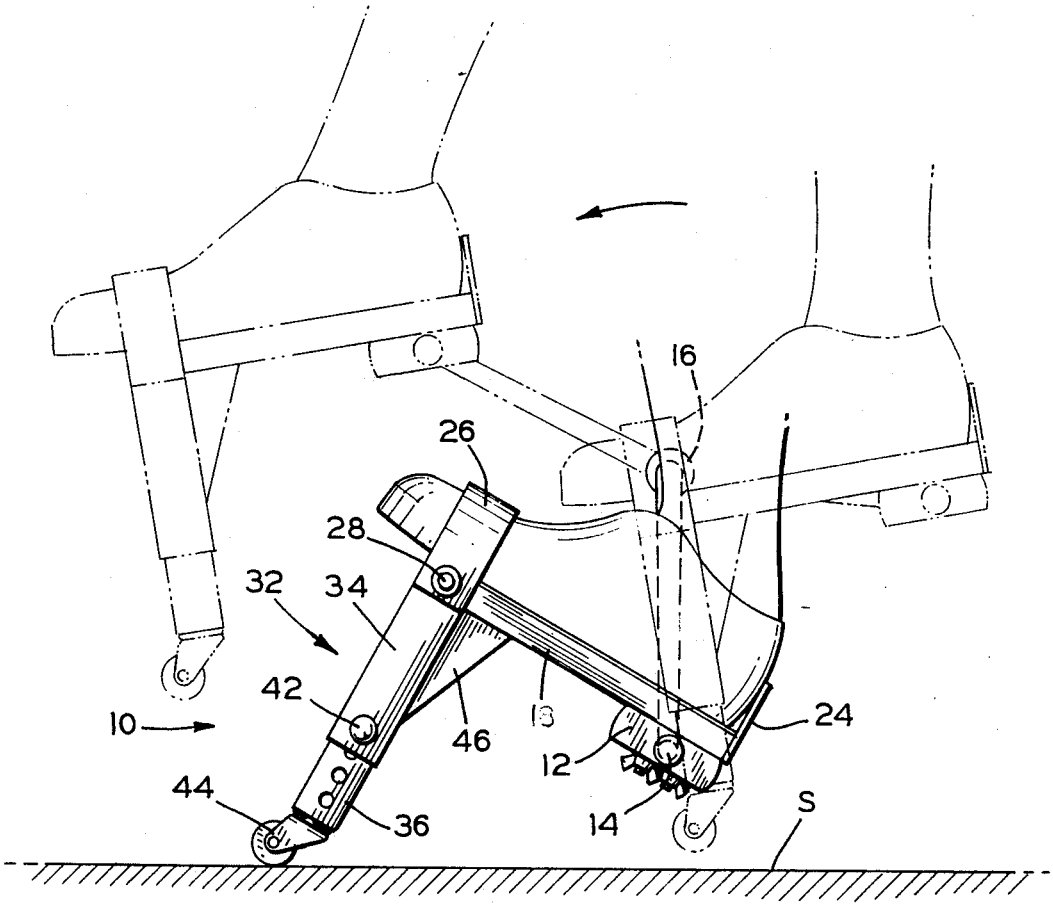
FIG. 3 is an elevational view of the invention as illustrated in FIGS. 1 and 2 showing a user's pedal extremity in an operative position in full line with other operative positions illustrated in phantom.

The operation of the invention is illustrated in FIG. 3. Initially, the user is positioned on the exercise bike. The user's feet are positioned on the attachment 10 such that the toe portion of the foot is under the strap 26 and the heel is adjacent the flange 24 with the soul placed firmly on the pad 30 of the foot support 18.

Force is then exerted to cause the attachment 10, the pedal 12, and associated crank arm linkage 14 to rotate counterclockwise about the bearing 16. In the full-line portion of the illustration FIG. 3 it will be observed that the leg 32 and the associated caster 44 has caused the foot support 18 and associated pedal 12 to pivot about the crank arm linkage 14 such that the angle formed by the user's foot and the user's leg or calf to assume an acute angle.

When the caster 44 first contacts the surface S, it rolls to the left as the rotation continues, and then the caster 44 rolls toward the right along the surface S as the pedal 12 commences to rise when the crank arm linkage 14 passes a completely vertical position. The geometry and the weight of the attachment 10 causes the toe of the user's foot to continuously drop with respect to the heel until the assembly has rotated to a point when the caster 44 once again comes into rolling contact with the surface S. When such contact is made, and rotation of the assembly continues, the user's foot is once again caused to experience considerable flexure in respect of the user's leg or calf. Surface S can be an impact absorbing surface that aids in the rolling action of the casters 44 as they roll in contact with surface S.

This repeated forced flexure assists in achieving the desired exercise and results in an improved circulatory system.

While the preferred embodiment has been illustrated and described, it must be understood that the embodiment is provided for the purposes of illustration and understanding and the invention may be practiced otherwise than as specifically illustrated without departing from the scope and spirit thereof.

What is claimed is:

1. An L-shaped attachment for a pedal and crank arm linkage of an exercise bike comprising:

a foot support for accommodating the foot of a user;

means secured to said foot support for limiting relative movement between the foot of a user and said support;

means for attaching said foot support to the pedal of the exercise bike generally at the perpendicular rotation; and roller means connected generally perpendicular to said foot support in spaced relation from said means for attaching said foot support to the pedal, and depending from said foot support to effect contact with a supporting surface during a portion of the rotation of the pedal and crank arm linkage thereby flexing the user's foot upon contact with said surface.

2. The invention defined in claim 1 wherein said means for limiting relative movement of the foot of a user includes a heel engaging means mounted adjacent one end of said foot support.

3. The invention defined in claim 2 wherein said heel engaging means includes an upstanding flange.

4. The invention defined in claim 2 wherein said means for limiting relative movement of the foot of a user includes a toe engaging means mounted adjacent the other end of said foot support.

5. The invention defined in claim 4 wherein said toe engaging means includes a strap encircling the upper portion of at least a portion of the foot of a user.

6. The invention defined in claim 1 wherein said means extending from said support to contact the surface is selectively extendable.

7. The invention defined in claim 1 wherein said means extending from said support to contact a supporting surface includes roller means to provide rolling contact with a supporting surface.

8. The invention defined in claim 1 wherein said means for attaching said foot support to the pedal include threaded fasteners.

* * * * *